US005645437A

United States Patent [19]

Meir

[11] Patent Number: 5,645,437

[45] Date of Patent: Jul. 8, 1997

[54] DEVICE OF A PLUG AND SOCKET

[76] Inventor: Amiram Meir, Nof Ramot 73/14, Jerusalem, Israel

[21] Appl. No.: 190,922

[22] Filed: Feb. 3, 1994

[30] Foreign Application Priority Data

Feb. 4, 1993 [IL] Israel ..... 104618

[51] Int. Cl.[6] ..... H01R 25/00

[52] U.S. Cl. ..... 439/110; 439/117; 439/115

[58] Field of Search ..... 439/117, 120, 439/209, 110, 216

[56] References Cited

U.S. PATENT DOCUMENTS

| | | | |
|---|---|---|---|
| 2,186,601 | 1/1940 | Berkenstein | 439/117 |
| 2,227,123 | 12/1940 | Christen | 439/117 |
| 2,437,579 | 3/1948 | Wilson . | |
| 3,603,918 | 9/1971 | Wofritz | 439/117 X |
| 4,173,382 | 11/1979 | Booty | 439/117 |
| 4,773,869 | 9/1988 | Smart et al. | 438/120 |
| 4,790,766 | 12/1988 | Booty, Sr. et al. | 439/117 |
| 4,973,796 | 11/1990 | Dougherty et al. | 439/117 |

FOREIGN PATENT DOCUMENTS

| | | | |
|---|---|---|---|
| 2255727 | 7/1975 | France | 439/209 |

*Primary Examiner*—Neil Abrams
*Assistant Examiner*—Brian J. Biggi
*Attorney, Agent, or Firm*—Lowe, Price, LeBlanc & Becker

[57] ABSTRACT

The invention discloses an electrical plug and socket. The socket is an elongated body made of rigid non-conductive material with two or three grooves along its body. A conductor connected to a power source passes inside, along and through every groove. This socket has at least one "station" for insertion or removal of the plug which is located along said socket. The plug is comprised of e cover and a body both made from non-conductive rigid material. Two or three rigid conductive bodies are located at the underbody of the plug and connected to an electrical cable passing through the cover. Said conductive bodies are contoured and located such that they fit for entry, sliding and grasping of the socket's grooves while continuously touching the sockets conductors inside said grooves. The advantage of the particular feature of the plug end socket according to the invention is that it minimizes the risk o electrocution by preventing foreign bodies from being inserted and touching the electric conductors.

29 Claims, 9 Drawing Sheets

FIG. 4a
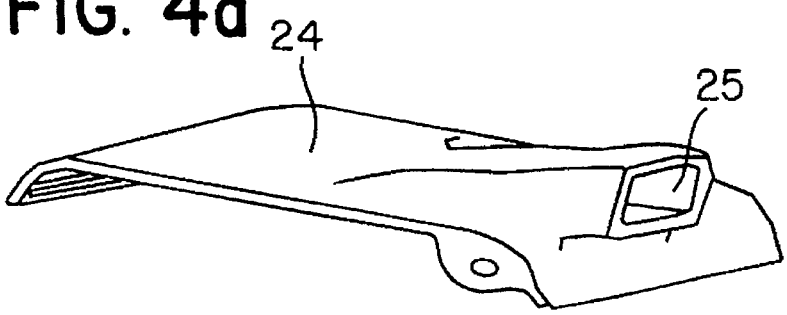
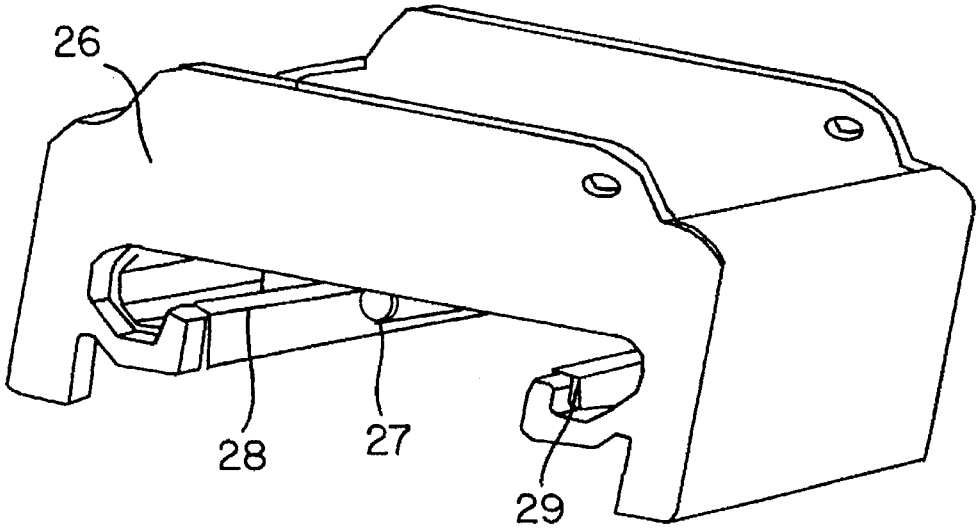
FIG. 4b
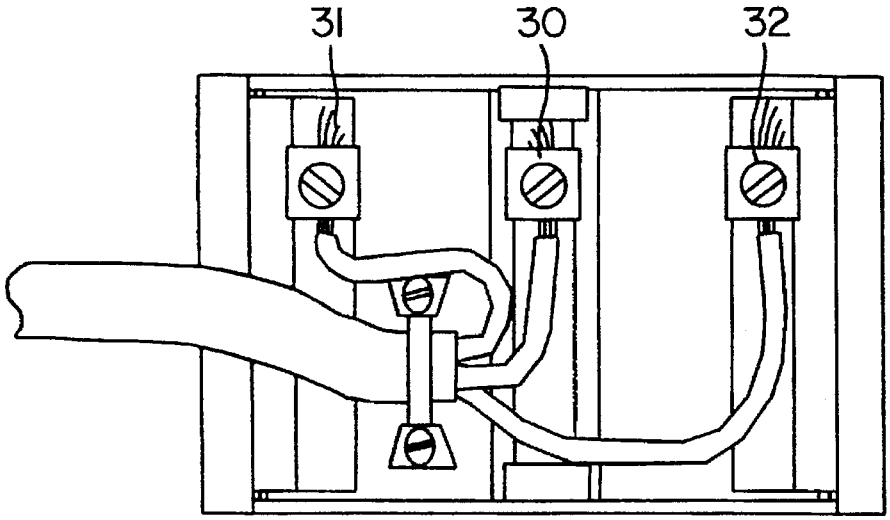
FIG. 4c

DEVICE OF A PLUG AND SOCKET

FIELD OF THE INVENTION

The present invention relates to a device of a plug and socket wherein the socket is used at a line for plugs that can slide and be located at any point along it's length.

BACKGROUND OF THE INVENTION

Today, electrical appliances are connected to e current source by the standard system of a plug and a socket that is based on pins of the plug inserted into he socket holes, The standard known plug and sockets have many disadvantages. Every country has is own standard, and there are differences in the countries in the various standards such as, shape of the pins the holes, and their sizes. These differences cause aggravation to electric appliance users who want to use their appliances in different countries.

Another disadvantage relating to the well-known standard plug and socket mentioned above is the fact that it is connected only to a specific point which doesn't allow the appliance to be moved to another point in the wall while in use. Furthermore, plugging in and pulling out the standard plug is inconvenient. Sometimes, in a dark room, it is especially difficult to insert the plug in the socket. One has to feel around for the holes of the socket while trying to plug in something, taking extreme care not to touch the pins of the plug by mistake. Pulling out he plug is also no convenient and occasionally necessitates the rotating and maneuvering of the plug while pulling it out of the socket. While removing one plug, other plugs may be moved and separated from their sockets and fall to the floor and also the socket may be separated from the wall.

Moreover, on the existing plugs, the pins are also used to hold the plug to the socket (in addition to their use enabling current to flow). In the event that the link between the plug end the docket is too strong, it is hard to plug in or remove the plug. In the event that the link is too weak, the plug just slips out of the socket.

The present invention overcomes the above mentioned disadvantages of the standard well-known plug and socket, and in addition has many other advantages. According to the plug and socket device of the present invention one can connect the plug into the socket in the dark. Blind people can connect the plug into the socket without any danger. There are no worries of electrocution because no one can touch the connection points between the plug and the socket. The socket according to the invention can hold many plugs along its length. It is possible to connect he plugs next to one another. A plug can "travel" along the length of the socket while in continuous use, as there is a constant current along the whole length. The connection between the plug and socket is stable, simple; strong, and allows for a plug socket connection on the ceiling (like light implements) which can not be done with existing standard known plugs and sockets.

The connection of the plug to the wall is simple, aesthetic and does not require special work done to the wall. It is possible to connect the existing known plug to a socket according to the present invention by simple modification. It is also possible to connect the socket to a standard known socket by simple modification (connecting standard plug pins to the mocker).

There is also the possibility of using this plug and socket device for other systems and appliances such as the plug and socket of a telephone system.

The conductive bodies in the plug and the conductors of the socket make contact on the backside of the socket which is far from the body of the plug. The advantage of this particular feature is that it minimizes the risk of electrocution. Moreover, the specific contour of the socket's groove prevents a foreign body, for example a hammer, from being inserted and touching the electric conductors, and enables only bodies with the appropriate matching contour to reach the socket's conductors (like a lock and key).

SUMMARY OF THE INVENTION

The present invention relates to an electrical plug and socket device wherein the socket is an elongated body made of a rigid non-conductive material with two or three grooves along its body and a conductor connected to a power source passes inside and through every groove and at least one "station" for insertion or removal of the plug is located along said socket and wherein the plug is comprised of a cover an a body both made from non-conductive rigid material, two or three rigid conductive bodies located at the underbody of the plug and connected to the electrical cable passing through the cover, and said conductive bodies are contoured and located such that they fit for entry, sliding and grasping of the socket's grooves while continuously touching the sockets conductors inside said grooves.

DETAILED DESCRIPTION OF THE INVENTION

The present invention will be described in detail by FIGS. 1–8,

Following is a short description of the figures:

FIG. 1, describes in isometrics a socket according to the invention.

FIG. 2 describes the socket in a view from above.

FIG. 3 a–d describe a cross section of the parts of the socket and the whole body of the socket such that: 3*a* describes a cross section of the lower part of the socket (the part that is attached to the wall); 3*b* describes a cross section of he meal conductive rigid line. 3*c* describes a cross section of the upper part of the socket (that is over the lower body). 3*d* describes a cross section of the whole socket.

FIG. 4*a* describes in isometrics the cover of the plug

FIG. 4*b* describes in isometrics the body of the plug

FIG. 4*c* describes the connections of the electric line to the body of the plug.

FIG. 5 describes a cross section of the plug,

FIG. 6 describes in a cross section of the plug connected to the socket.

FIG. 7 describes from above several plugs connected to the socket in different widths.

FIG. 8 describes in isometrics the possibility of connecting two sockets together.

Following is a detailed description of the above mentioned figures. This description is an example of a preferred embodiment of the invention and in no way intends to limit the scope of the invention.

Figure 1:
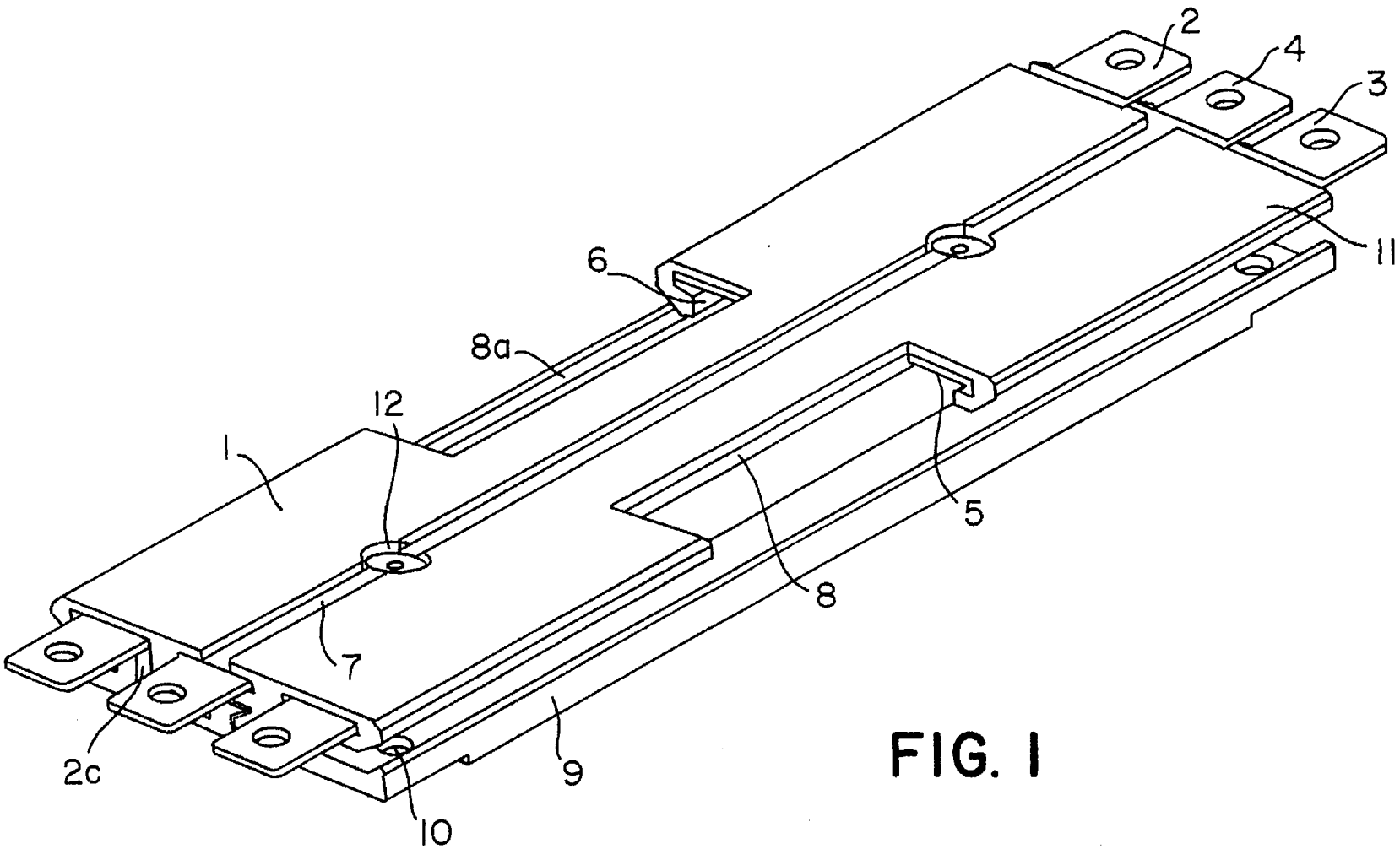

FIG. 1 describes with Isometrics the socket according to the invention.

The socket is an elongated body (1) and through it pass three conductors (3) and (4). The conductors (2) and (3) serve as current passage lines and conductor (4) lot grounding. The line connected to the ground is optional, and the socket can operate without it. These three lines are found along three grooves (5), (6), and (7) that pass along the length of both sides of the body (5) and (6) and one along its middle (7). The two current lines and the line connected to he ground protrude from the two sides of the path for optional connection of he socket to an external source of current and also as an optional connection to another socket. Its also possible to make a body without protruding conductors in the case when one does not want the option of connecting the sockets one to another.

The conducting lines 2 and 2, although they protrude at the end as a planar elongated conductor, inside the body they bend at a 90 degree angle. This can be seen in detail in FIG. 3D. In this figure, it is somewhat difficult to see the conductors that are perpendicular to conductors 2 and 3 that give the 90 degree angle. The main conductor that is perpendicularly attached to conductor 2 is 2*c* and it together with 2 create a 90 degree angled conductor. These conductors can be two planar straight conductors that can be connected perpendicularly or one conductor that i angled at 90 degrees.

Along the elongated body of the socket there is at least one "station" of entry and exit that allows inserting and removing of the plug from the socket and this "station" is created by openings 8 and 8*a* in the sleeves of the elongated body that allow the freeing of the plug from the grooves or inserting the plug into the grooves when the action to insert the plug is perpendicular to the socket, end then sliding it along the right or left of said station, and the reverse action to pull it out. In FIG. 1 the conductors 2 and 3 partially cut in the station, but the conduction is saved as the perpendicular part of the conducting band is not completely cut and enables the continuous conduction (see 2C). There is an option to completely cut the conductor in the station and ensure the continuous flow of electricity with a bypass wire. The lower part of the socket (9) may be fixed to the wall, the ceiling, or to any other area with screws (10) or screws (12). Afterwards the conductor and the upper part of the socket are connected to the lower part by inserting it into the lower part and by screws (12).

The way the socket is connected on its parts as it is detailed in the figure is only an example of a quick and easy way to connect it to a wall. (It is possible to build it in other ways as well.)

Figure 2:
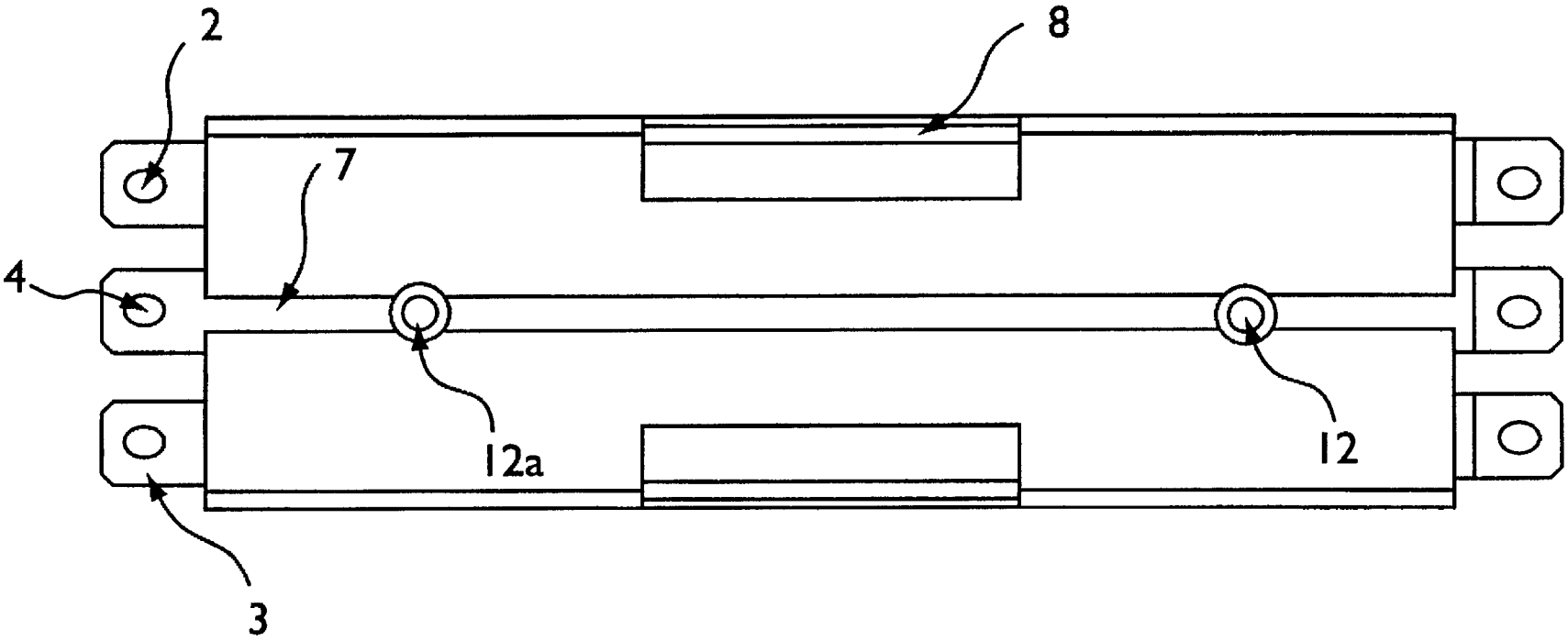

FIG. 2 describes the socket from an overview. The groove (7) that uses the ground conductor (4) passes along the length of the socket. The entrance and exit station (8) allows for inserting and removing of the plug. The metal conductors (2), (3), and (4) protrude from the two sides of the plug for and optional connection to a source of current and for the possibility of connecting an additional socket. The screws (12) and (12*a*) are used to connect the upper part of the socket to its lower part that is attached to the wall (or the appendage of the entire socket to the wall). The two parts of the socket, the upper and the lower parts (not including the conductors) are made of an isolating plastic material.

FIG. 3 illustrates a cross-section of the various parts of the socket, separately and assembled.

Figure 3D:
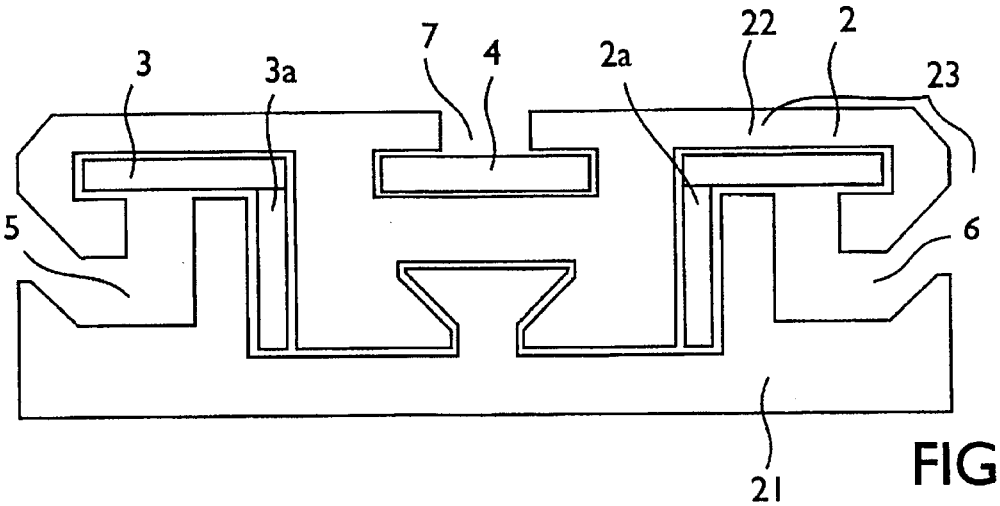
Figure 3C:
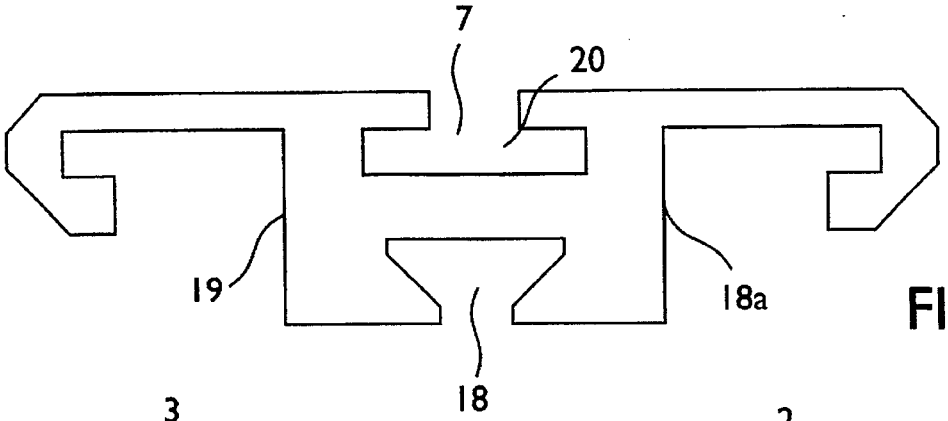
Figure 3B:
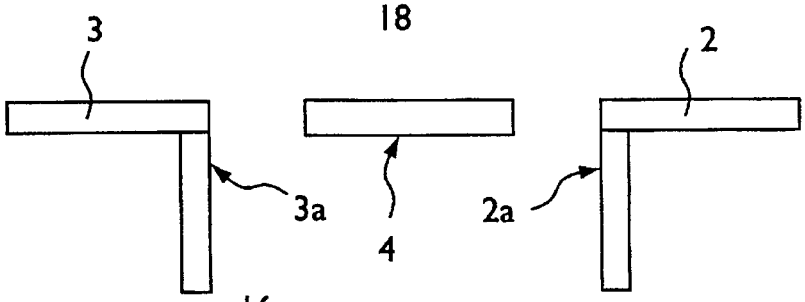
Figure 3A:
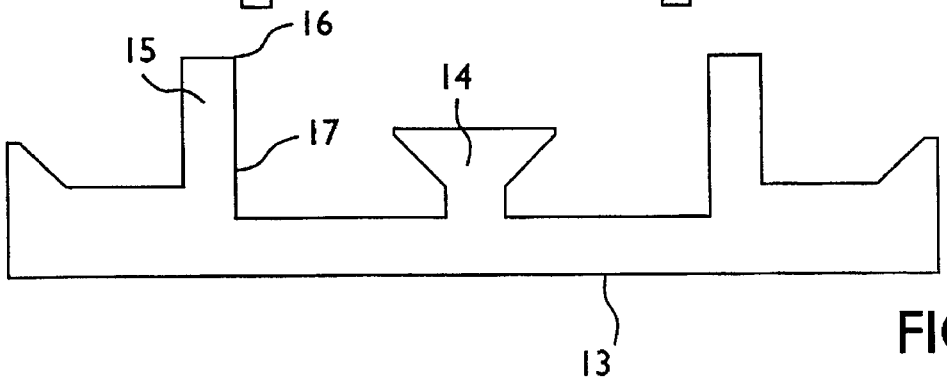

FIG. 3*a* describes in cross-section of the lower part of the socket. (This part is attached to the wall or to the ceiling.)

It is worth noting that inherent to the device is that the sockets can be used without an attachment to the wall, ceiling or any other stationery body.

The lower part is made of isolated rigid plastic material and is one integral part. The surface (13) is attached to the wall or the ceiling by screws (or in any other feasible way). Along the length of the center of the body passes a protrusion (14) which widens as it rises and the upper part will be inserted and fitted through it (through the groove (18) FIG. 3*c*). The two protrusion (15) are for the placing of the conductors [(2), (2*a*), (3), (3*a*) in FIG. 3*b*, see also 3d] on the face (16) and on the side (17) of every protrusion (15) in an L shape.

FIG. 3*b* describes a cross-section of the conductors (2*a*), (3), (3*a*) and (4) situated in such a manner as they are located in the socket. The conductors (2), and (2*a*) together give one conductor in the shape of an L and the same is true of conductors (3) and (3*a*). At the "stations" for the entrance and exit of the plug, the current passes only through lines (2*a*) and (3*a*) because of the cut in the face of the socket.

FIG. 3*c* describes in a cross-section the upper body of the socket.

This body is made of one integral part from rigid plastic material. On its underside is a slot (18) widens towards the surface and adjusts its measurements to the protrusion (14) of the lower part. This slot is threaded along the protrusion (14) of the lower portion and thus the upper part of the socket and its lower half that is fixed to the wall are easily connected together. The final connection of these two parts may be done with screws. While attaching the upper and lower parts of the socket, areas are created between the upper and lower part from the two sides (18*a*) and (19) that are appropriate for the laying of the conductors. Also, in the upper part, under the slot (7) there is a pace (20) appropriate in its contour for the laying of a ground conductor.

FIG. 3*d* describes in a cross-section the whole electrical socket according to the invention.

The lower plastic part of the socket (21) and the upper plastic part that is threaded through it (22) and the conductors (2), (2*a*) and (3), (3) and the grounding conductor (4). The combination of all these parts together create the side slot (5) and (6) and a main slot (7) that under every one of each slot passes a conductor. The conducting bodies of the plugs are meant to insert into the above mentioned slots and the ends of the conducting bodies of the plug are meant to touch the socket conductors. This configuration of the socket is very safe end doesn't allow children to touch the conductors. The side slots of the socket are in the shape of an L and allow a strong connection between the plug and socket and also enables the plug to "travel" along the socket's length. In the areas of the "stations," the marked part (23) is absent and allows the removal of the plug from the socket or for the insertion of the plug into the socket.

FIG. 4*a* describes plug cover (24).

The cover of the plug coves and wraps its upper section. There is an opening (25) in the cover through which enters an electric cable from the electrical appliance into the body of the plug.

FIG. 4*b* describes through isometrics the body of the plug

The body of the plug and the cover of the plug are made of isolated rigid plastic material. A conducting rigid body (27) protrudes from the center of the underbody for grounding purposes, and from the two sides are two conductors (28) and (29). These two conductors are located in appropriate positions and contours for the entrance and the grasping of the slots in the socket. The rigid conductors in the plug and also in the socket can be made of any electrically conductive material such as copper, aluminum or brass.

FIG. 4*c* describes an overview of the connections of the electric lines to the conductors in the plug.

A connection to the round (30) ad connections of current (31) and (32).

Figure 5:
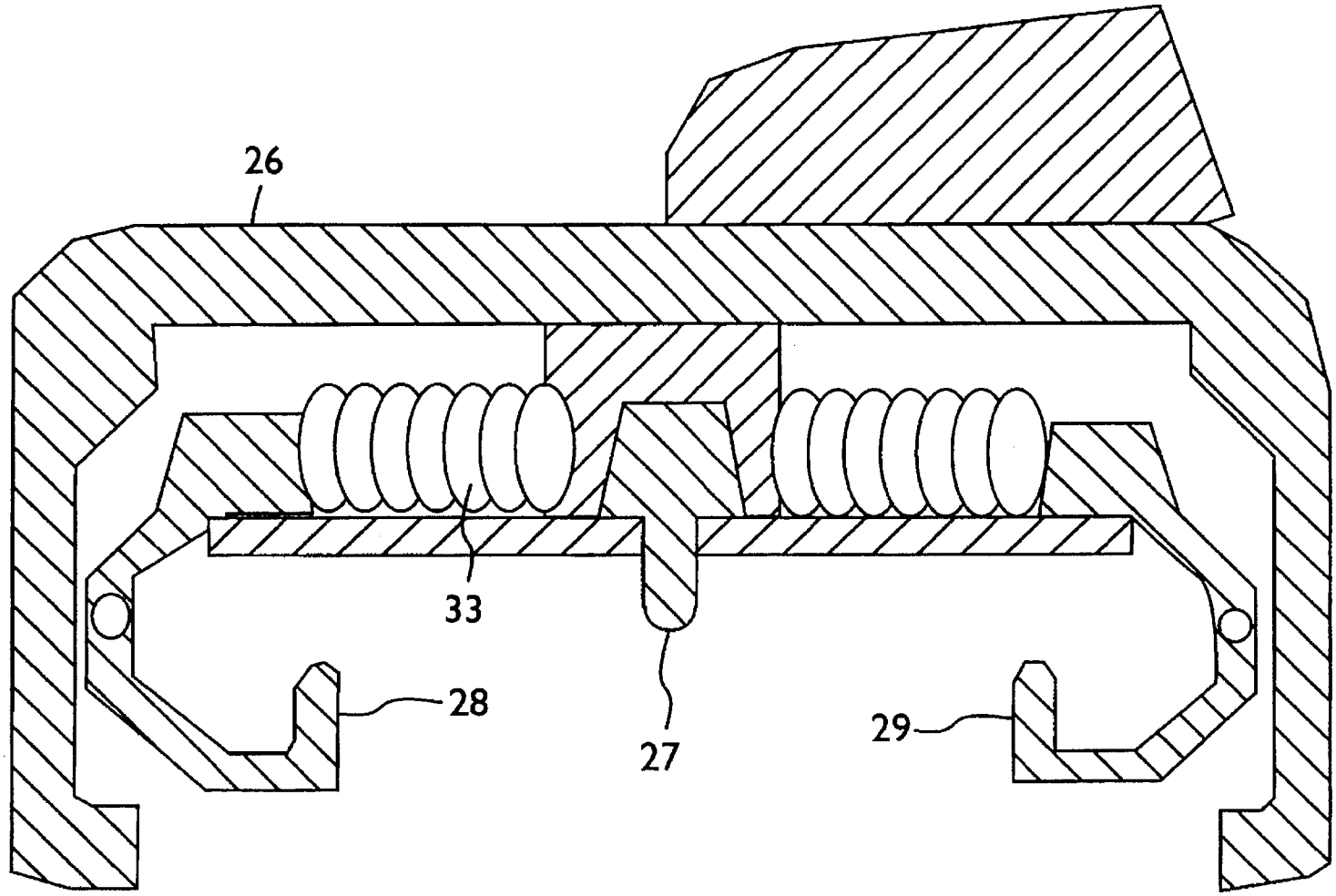

FIG. 5 describes in detail a cross-section of the plug.

From the body of the plug (26) that is closed from above and from the two sides three rigid conductors emerge that are appropriately positioned for entrance into the slots of the socket. From above, in a central protrusion rigid conducting body protrudes (27) (for grounding), and from the two sides protrude in the shape of an L at a 90 degree angel rigid conducting bodies (28) and (29) that are fitted in their location and contour for entrance into the slots of the socket ((6) and (7) that were described in FIG. 3*d*). The ends of these conducting bodies in the plug touch the socket conductors ((2), (3), and (4) that were described in FIG. 3). There is also a possibility that the cover is adjacent to the conducting bodies and both can enter the slots.

Two springs in the body of the plug (33) press the conductors in the plug outwards. Thus the plug Is grasped more firmly in the socket. The conducting bodies can be used themselves as they have the qualities of a spring.

Figure 6:
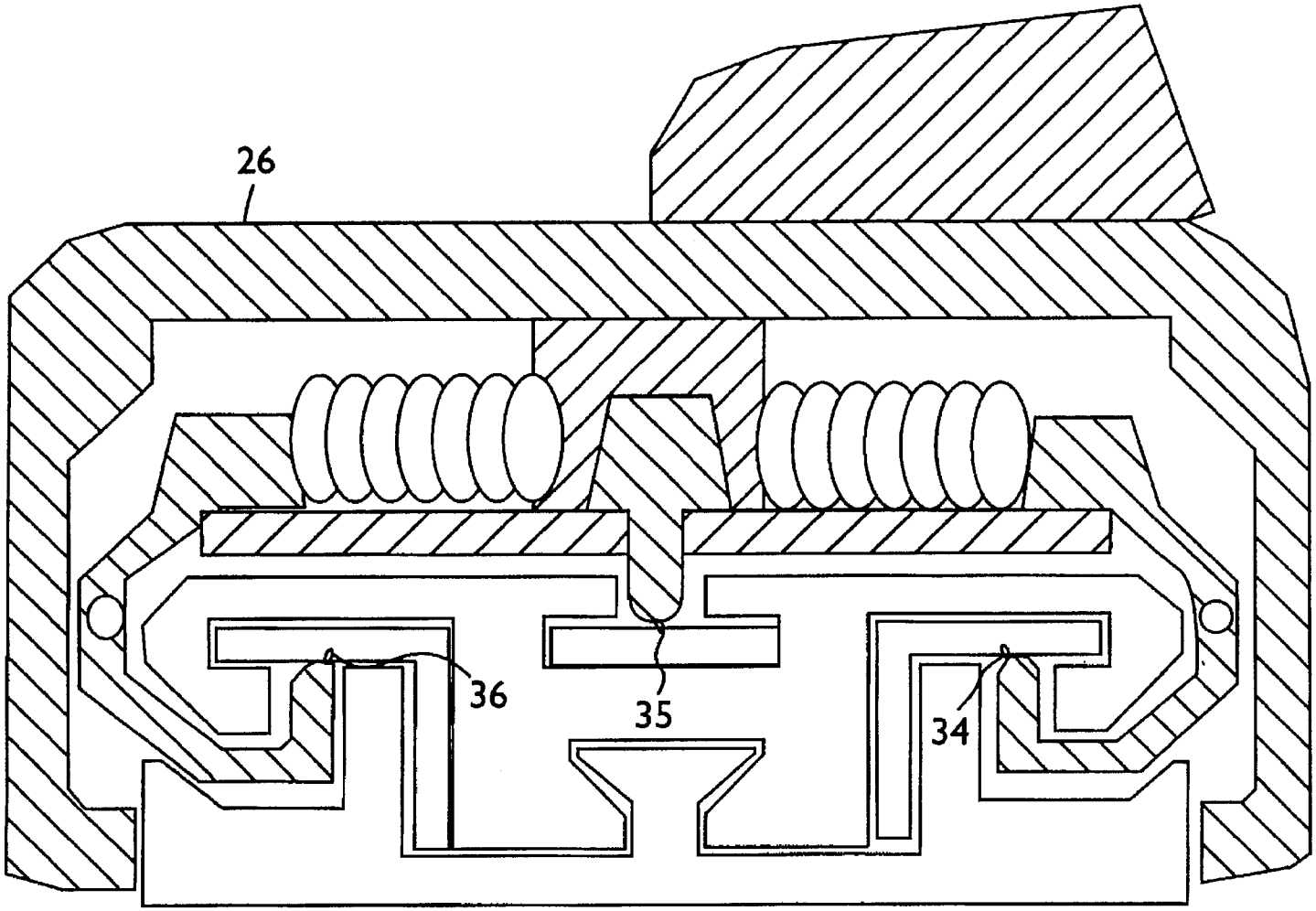

FIG. 6 describes in a cross-section the plug plugged into the socket.

The body of the plug (26) closes and wraps the socket from three sides, preventing any possibility of a person touching the conductors. The points of contact between the conducting bodies of the socket and plug (34), (35), and (36) are at the ends of the slots in the socket. The special contour and construction at the socket sides for the connection with the plugs is at 90 degree angles between the body of the plug and the slots of the socket which creates a strong hold between the plug and socket. One can't free the socket from the plug except at the "stations" where there is no angled slot.

Figure 7:
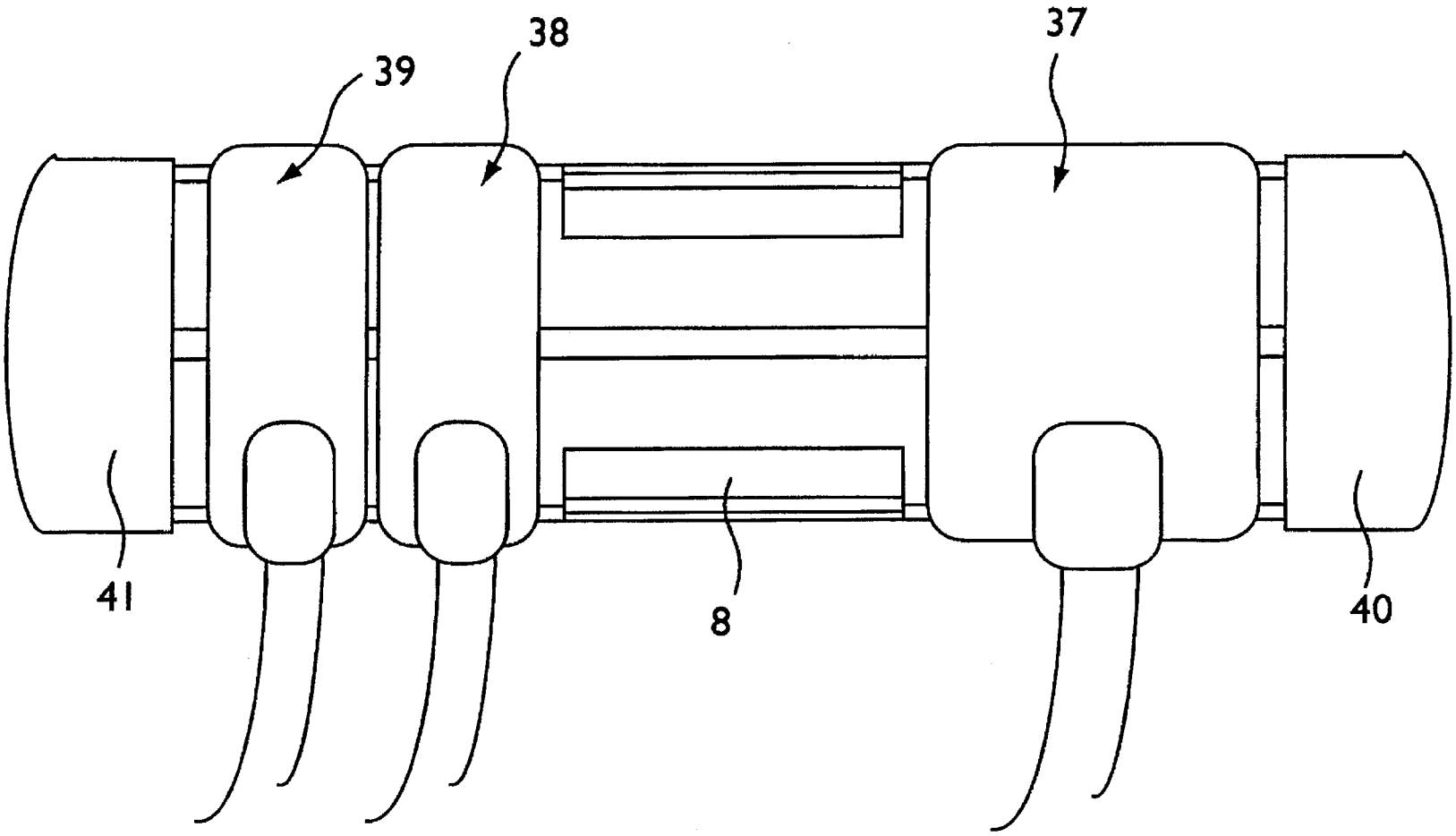

FIG. 7 describes from an overview the socket where several plugs can be connected.

In this figure three plugs (37), (38) and (39) that are connected to one socket are exemplified. The socket is closed by two covers (40) and (41) at the two ends to prevent contact with the conductors. The plugs are inserted to the socket through the exit and entrance "station" of the plugs (8). The socket can be longer and accommodate more plugs. It is also possible to build a long socket with several "stations" or to join several sockets one to another.

An advantage of this invention is that the width of plugs can be determined by the electric load of the appliance and be proportional to the amount of its current consumption.

Figure 8:
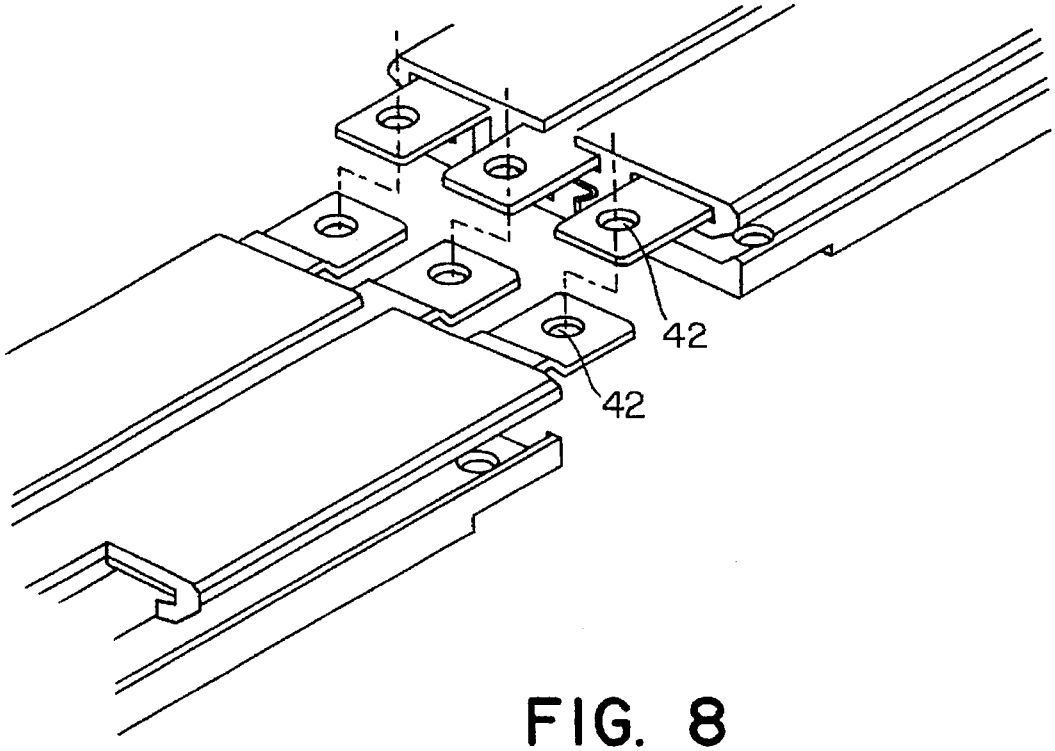

FIG. 8 describes through isometrics the possibility connecting two sockets one to another.

The preferred possibility is closure through screws, that pass in the holes (42) at the edges of the conductors that are laid one above the other on adjacent sockets. The area of connection may be closed through a plastic cover.

The invention that has been described, describes a plug and socket also with the conductor connected to the ground. The device may also work without grounding as is accepted in certain countries.

Figure 9:
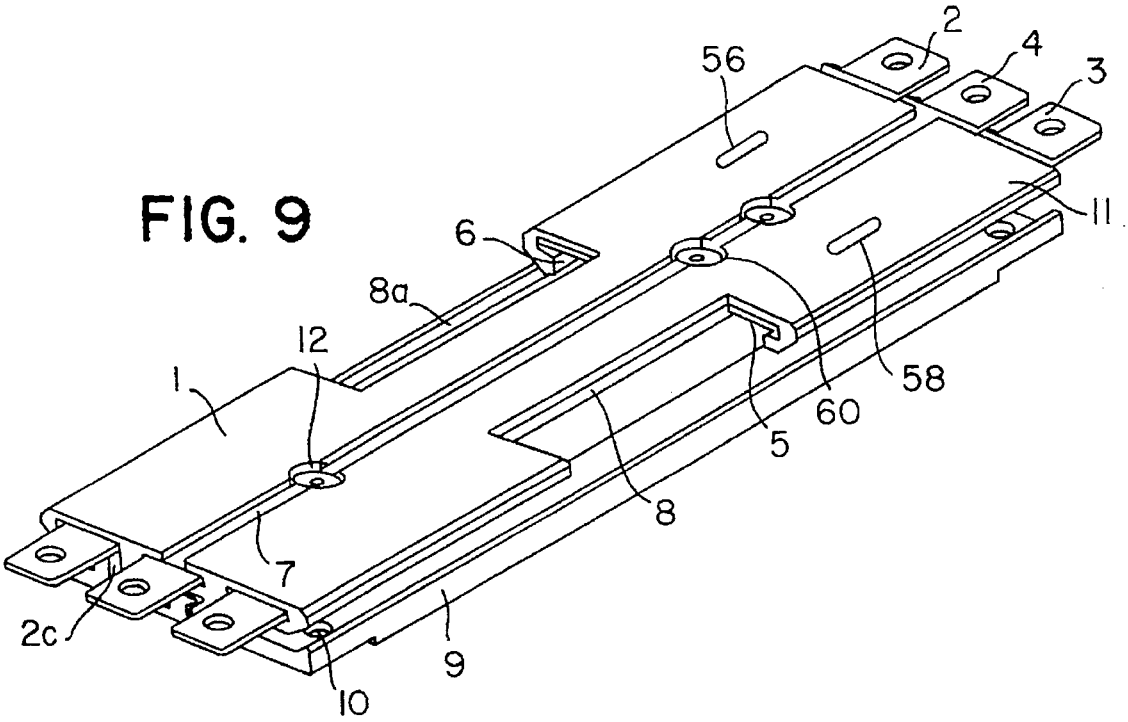
FIG. 9 is an isometric view of an alternate embodiment of the present invention.
Figure 10:
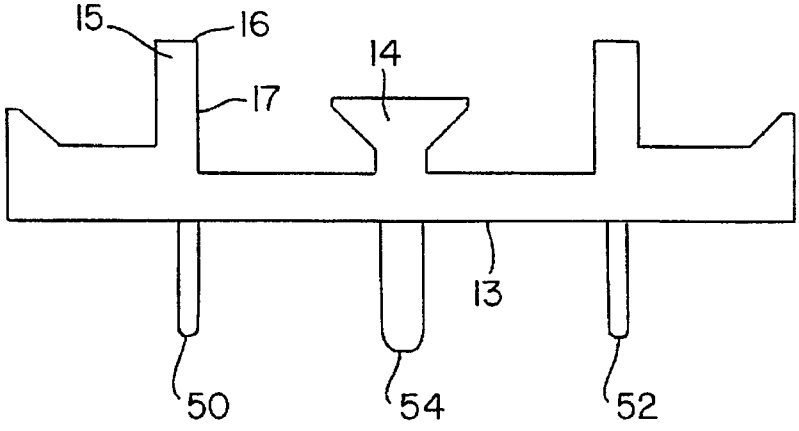
FIG. 10 is a cross-sectional view of the lower part of the socket of the embodiment of FIG. 9.

The unique plug and socket according to the present invention can also operate in conjunction with the standard known plugs and sockets as shown in FIGS. 9 and 10. If a standard socket already exist in the wall the socket, according to the invention, can be modified and may also have protruding pins 50, 52, 54 exactly as in the standard plug. If a standard plug is to be used the socket, according to the invention, may be modified by an addition of the standard two or three holes 56, 58 and 60.

I claim:

1. An electrical plug and socket device comprising:

a socket including an elongated body made of a rigid non-conductive material and including at least one station for insertion and removal of the plug therein, said body comprised of a lower part for attachment to a wall, an upper part disposed thereon and plural conductors connected to a power source and disposed between the upper and lower parts, the lower part including one of a protrusion and groove passing along a center thereof, the upper part including the other of said protrusion and groove on the underside thereof adapted to be inserted, fit and fixed on the protrusion or groove of the lower part, the lower part and the upper part being contoured so that when joined, plural grooves are formed between the upper and lower parts in which the plural conductors extend, at least one of the grooves having a cross section including a plurality of successive inclines defined by at least three angularly offset planar sections; and a plug comprising a body made of a non-conductive material, at least two immovable conductive bodies located at an underside of the plug and connected to an electrical cable passing through the body, at least one of the conductive bodies is a conductor having a cross section including a plurality of successive inclines defined by at least three angularly offset conductive planar sections conforming to the plurality of successive inclined planar sections of the groove, wherein the plug fits for entry and removal in the socket through the station which enables the conductive bodies of the plug to be slid and grasped through the socket grooves with the successive inclines of the plug fitting into the successive inclines of the groove while continuously touching the conductors inside the grooves.

2. An electrical plug and socket device according to claim 1 wherein the socket has three grooves passing along its body, one along its middle and two along the length of both sides, wherein the plug has three rigid conductive bodies, one rigid conductive body protruded from the center of the underbody and two rigid conductive bodies protrude from the two sides and these three conductors are located in appropriate positions for the entrance and grasping of the grooves in the socket.

3. An electrical plug and socket device according to claim 2 wherein the conductors along the center of the socket and in the center of the plug are for grounding.

4. An electrical plug and socket device according to claim 1 wherein the conductors in the plug end socket are made of copper, aluminium or brass.

5. An electrical plug and socket device according to claim 1, wherein at least one of the conductors of the socket is an angled conductor shaped in a 90 degree angled cross section.

6. An electrical plug and socket device according to claim 5, wherein the upper part includes a groove to receive a portion of the 90 degree angled conductor inside it, and wherein the upper and lower parts, when secured, provided a 90 degree angled groove adapted to receive the 90 degree angled conductor therein.

7. An electrical plug and socket device comprising:

a socket including an elongated body made of a rigid non-conductive material and including at least one station for insertion and removal of the plug therein, said body comprised of a lower part for attachment to a wall, an upper part disposed thereon and plural conductors connected to a power source and disposed between the upper and lower parts, the lower part including a protrusion passing along a center thereof, the upper part including an appropriate groove on the underside thereof adapted to be inserted, fit and fixed on the protrusion of the lower part, the lower part and the upper part being contoured so that when joined, plural grooves are formed between the upper and lower parts in which the plural conductors extend, at least one of the grooves having a cross section including a plurality of successive inclines; and an electrical plug including a body made of non-conductive materials, at least two immovable conductive bodies located at an underside of the plug and connected to an electrical cable passing through the body, at least one of the conductive bodies is a conductor having a cross section including a plurality of successive inclines conforming to the plurality of successive inclines of the groove, wherein the plug fits for entry and removable in the socket through the station which enables the conductive bodies of the plug to be slid and grasped through the socket grooves with the successive inclines of the plug fitting into the successive inclines of the groove while continuously touching the conductors inside the grooves, wherein the station is formed by an opening intersecting at least one of the socket's grooves and passes through a conductor which is partially cut in the station area so that the plug conductor can be moved in one direction through the cutout section of the conductor and then moved transversely to the one direction into engagement with the conductor.

8. An electrical plug and socket device comprising:

a socket including an elongated body made of a rigid non-conductive material and including at least one station for insertion and removal of a plug therein, said body comprised of a lower part for attachment to a wall, an upper part disposed thereon and plural conductors connected to a power source and disposed between the upper and lower parts, the lower part including a protrusion passing along a center thereof, the upper part including an appropriate groove on the underside thereof adapted to be inserted, fit and fixed on the protrusion of the lower part, the lower part and the upper part being contoured so that when joined, plural grooves are formed between the upper and lower parts in which the plural conductors extend, at least one of the grooves having a cross section including a plurality of successive inclines; and said plug comprising a body made of a non-conductive material, at least two immovable conductive bodies located at an underside of the plug and connected to an electrical cable passing through the body, at least one of the conductive bodies is a conductor having a cross section including a plurality of successive inclines conforming to the plurality of successive inclines of the groove, wherein the plug fits for entry and removable in the socket through the station which enables the conductive bodies of the plug to be slid and grasped through the socket grooves with the successive inclines of the plug fitting into the successive inclines of the groove while continuously touching the conductors inside the grooves;

wherein the station is formed by an opening intersecting at least one of the socket's grooves and passes through a conductor which is completely cut in the station area, the device further comprising a bypass wire ensuring a continuous flow of electricity through the station.

9. An electrical socket comprising an elongated body made of a rigid non-conductive material with at least two continuous grooves along the body, and plural conductors extending respectively through said grooves for connection to a power source, at least one of said grooves is bent in 90 degree angle and the conductor extending through the at least one of said grooves is also an angled conductor shaped in a 90 degree angle cross-section, and at least one station for insertion and removal of a plug is located along said socket.

10. An electrical socket according to claim 9 wherein the socket has three grooves passing along its body, one along is middle and two along the length of both sides.

11. An electrical socks; according to claim 10 wherein the conductor that passes inside the groove along its center is for grounding.

12. An electrical socket according to claim 9 comprised of a made from non-conductive rigid material for attachment to a wall, and along the center of said lower part passes a protrusion which widens as it rises and an upper part also made from non-conductive rigid material which has an appropriate groove in its underbody, is inserted, fitted and fixed on said protrusion of the lower part and these lower and upper parts are contoured so that when joined, two conductors in each side can be inserted in the space created between them creating 90 degree angled conductors in each side and a 90 degree curved groove in each side leading to each side conductor, and a groove passes along the center of the upper part and a conductor inside it.

13. An electrical socket according to claim 5 wherein the socket is connected to another similar socket by connecting the ends of the conductors of one socket to the next.

14. An electrical socket according to claim 9 wherein said socket has at its back at least two protruding rigid conducting pins, like standard plugs, for insertion into a standard socket in the wall.

15. A electrical socket according to claim 9 having, in addition, as an integral part, a standard at least two hole socket.

16. An electrical socket comprising an elongated body made of a rigid non-conductive material with at least two continuous grooves along the body, and plural conductors extending respectively through said grooves for connection to a power source, and at least one station for insertion and removal of a plug is located along said socket; wherein the station is formed by an opening intersecting the at least one of the grooves of the elongated body and passes through at least one of the conductors which is partially cut in the station area.

17. An electrical socket comprising an elongated body made of a rigid non-conductive material with at least two continuous grooves along the body, and plural conductors extending respectively through said grooves for connection to a power source, and at least one station for insertion and removal of a plug is located along said socket; wherein the station is formed by an opening intersecting the at least one of the grooves of the elongated body and completely cuts the conductor in the station area while ensuring the continuous flow of electricity with a bypass wire.

18. An electrical plug comprising a body made from non-conductive rigid material, at least two immovable conductive bodies located at an underside of said plug and connected to an electrical cable passing through the body, said conductive bodies including a substantially fixed conductor having a plurality of successive inclines in the form of at least three angularly offset planar sections, said plug fits for entry and removal in one direction in a corresponding socket through a station which is located along the body of the socket enabling the plug to be grasped and said conductive bodies of the plug to be slid transversely to the one direction through at least one groove in the socket while continuously touching the conductors inside said grooves having corresponding angular offset sections.

19. An electrical plug according to claim 18 wherein the plug has three rigid conductive bodies, one rigid conductive body protrudes from the center of the plug underside and two rigid conductive bodies protrude from two sides, and these three conductors are located in appropriate positions for the entrance, sliding and grasping of grooves within a corresponding socket.

20. An electrical plug according to claim 19, wherein the rigid conductive body protruding from the center is for grounding.

21. An electrical plug according to claim 18 further comprising two springs in the body of the plug which press the conductive bodies the plug outwards.

22. An electrical plug according to claim 18, wherein three rigid conducting bodies are provided comprising two side conductive bodies and a central protrusion.

23. An electrical plug comprising a body made from non-conductive rigid material, at least two immovable conductive bodies located at an underside of said plug and connected to an electrical cable passing through the body, said plug fits for entry and removal in a corresponding socket through a station which is located along the body of the socket enabling said conductive bodies of the plug to be slid and grasped through the grooves in the socket while continuously touching the conductors inside said grooves;

wherein at least one of the conductive bodies is substantially L shaped having an additional 90 degree angle bent at its free edge.

24. An electrical socket comprising:

an elongated body made of a rigid non-conductive material including at least two continuous grooves along the body, plural conductors extending respectively through said grooves for connection to a power source, and a station formed by an opening in said elongated body cooperating with at least one of the grooves for insertion and removal of a plug, said elongated body comprising a lower part made from a non-conductive rigid material for attachment to a wall, an upper part also made from a non-conductive rigid material, the lower part including one of a protrusion and groove and the upper part including the other of said protrusion and groove in its underbody adapted to receive the protrusion or groove of the lower part, thereby securing the lower part to the upper part, wherein at least one of the grooves has a cross section including a plurality of successive inclines in the form of at least three angularly offset planar sections adapted to receive a conductive body of the plug having a conforming cross section including a plurality of successive inclines.

25. An electrical socket comprising:

an elongated body made of a rigid non-conductive material including at least two continuous grooves along the body, plural conductors extending respectively through said grooves for connection to a power source, and a station formed by an opening in said elongated body cooperating with at least one of the grooves for insertion and removal of a plug, said elongated body comprising a lower part made from a non-conductive rigid material for attachment to a wall, an upper part also made from a non-conductive rigid material, the lower part including one of a protrusion and a groove and the upper part including the other of said protrusion and groove in its underbody adapted to receive the protrusion or groove of the lower part, thereby securing the lower part to the upper part, wherein said groove has a cross section including a plurality of successive inclines adapted to receive a conductive body of the plug having a conforming cross section including a plurality of successive inclines;

wherein the conductors include a 90 degree angled conductor, the groove receiving a portion of the 90 degree angled conductor inside it, and wherein the upper and lower parts, when secured, provide a 90 degree angled groove adapted to receive the 90 degree angled conductor therein.

26. An electrical socket comprising an elongated body made of a rigid non-conductive material with at least two continuous grooves along the body, and plural conductors extending respectively through said grooves for connection to a power source, a station formed by an opening in the elongated body intersecting at least one of the grooves for insertion and removal of a plug, the plural conductors being completely hidden behind an insulating wall along the entire extent of the station to avoid electrocution and short circuiting in the station opening, said plug being moved in one direction for insertion at the station through the opening and then moved transversely to said one direction for electrical contact with said plural conductors only at locations adjacent and outside said station opening.

27. An electrical socket according to claim 26, wherein the station passes through a conductor which is partially cut in the station area.

28. Art electrical socket according to claim 26, wherein the plural conductors includes a ground, and wherein the ground is not hidden behind the insulating wall at the station.

29. An electrical socket comprising an elongated body made of a rigid non-conductive material with at least two continuous grooves along the body, and plural conductors extending respectively through said grooves for connection to a power source, a station formed by an opening in the elongated body intersecting at least one of the grooves for insertion and removal of a plug, the plural conductors being completely hidden behind an insulating wall along the entire extent of the station to avoid electrocution and short circuiting in the station opening; wherein the station passes through a conductor which is completely cut in the station area, the device further comprising a bypass wire ensuring a continuous flow of electricity through the station.

* * * * *